United States Patent [19]

Tüns et al.

[11] Patent Number: 4,836,384

[45] Date of Patent: Jun. 6, 1989

[54] CARTON, PARTICULARLY FOR LIQUIDS AND BLANK THEREFOR

[75] Inventors: Heinz J. Tüns, Dachsen; Herbert Hiss, Diessenhofen, both of Switzerland

[73] Assignee: Sig Schweizerische Industrie-Gesellschaft, Neuhausen am Rheinfall, Switzerland

[21] Appl. No.: 285,385

[22] Filed: Dec. 16, 1988

Related U.S. Application Data

[63] Continuation of Ser. No. 942,983, Dec. 17, 1986, abandoned.

[30] Foreign Application Priority Data

Dec. 19, 1985 [CH] Switzerland ..... 5416/85

[51] Int. Cl.[4] ..... B65D 5/72

[52] U.S. Cl. ..... 206/621.3; 206/621.7; 206/626

[58] Field of Search ..... 206/621.2, 621.1, 621.3, 206/620, 621, 626, 621.7

[56] References Cited

U.S. PATENT DOCUMENTS

| | | | |
|---|---|---|---|
| 2,583,211 | 1/1952 | Fleming | 229/7 R |
| 3,104,793 | 9/1963 | Hickin | 229/17 R |
| 3,133,689 | 5/1964 | Rossi | 229/17 R |
| 3,361,308 | 1/1968 | Rumberger | 229/17 R |
| 3,795,359 | 3/1974 | Rausing | 206/621.2 |
| 3,887,125 | 6/1975 | Trentesaux | 206/620 |
| 4,113,103 | 9/1978 | Carlsson | 229/7 R |
| 4,126,263 | 11/1978 | Martensson | 229/17 R |
| 4,367,828 | 1/1983 | Reil | 229/7 R |
| 4,632,299 | 12/1986 | Holmberg | 229/17 R |

FOREIGN PATENT DOCUMENTS

| | | | |
|---|---|---|---|
| 946425 | 7/1956 | Fed. Rep. of Germany | 229/7 R |
| 1486682 | 11/1970 | Fed. Rep. of Germany . | |
| 2208891 | 8/1973 | Fed. Rep. of Germany . | |
| 2407175 | 8/1975 | Fed. Rep. of Germany . | |
| 2804812 | 8/1979 | Fed. Rep. of Germany . | |
| 2939093 | 4/1981 | Fed. Rep. of Germany . | |

*Primary Examiner*—Gary E. Elkins
*Attorney, Agent, or Firm*—Spencer & Frank

[57] ABSTRACT

A carton for storing flowable material has a side face formed of a side panel and an adjoining top face formed of top flaps and a triangular ear formed from one of the top flaps and being situated in a zone where the side face and the top face adjoin. A weakening line which is provided in the triangular ear encloses an area portion of the triangular ear. The latter is folded flat against the side panel and the area portion enclosed by the weakening line is firmly bonded to the side face of the carton. The triangular ear is free of a firm bond with the side face externally of the area portion enclosed by the weakening line, whereby upon lifting the triangular ear away from the side face, the area portion tears out of the triangular ear along the weakening line and thus remains bonded to the side face of the carton for obtaining a pouring aperture in the triangular ear, delimited by the weakening line.

12 Claims, 2 Drawing Sheets

CARTON, PARTICULARLY FOR LIQUIDS AND BLANK THEREFOR

This application is a continuation of application Ser. No. 06/942,983, filed Dec. 17, 1986, now abandoned.

BACKGROUND OF THE INVENTION

This invention relates to a carton, particularly for packaging liquids and a blank therefor. The carton is made of a cardboard sheet bilaterally coated with a heat-sealable synthetic material and has a sealed pouring aperture which is opened by the consumer by breaking (tearing) the seal. the blank has panels separated from one another by fold lines. The panels comprise a first wide panel flanked by two narrow side panels. Each side panel is adjoined by a half panel which, when the carton is formed, are connected to one another by a longitudinal seam to form a second wide panel. All these panels together form a panel field adjoined at the top and bottom by a flap field for forming, by a central transversal seam, a gable portion which can be folded flat.

In cartons for liquids, problems involving the formation and operation of pouring apertures are well known. The apertures should be closed airtight when the carton is marketed, and they should be easily openable to ensure that children, aged and frail persons may open the package without the need to resort to any implement. The pouring aperture should have or should be brought into such a shape which ensures air admission to make possible an even outflow of the contents. Further, the pouring aperture should be at a location which makes possible a filling of the carton with little or no air admission, because the presence of air in the carton leads to an accelerated spoiling of the contents and also represents an unused space resulting in the need for additional material having added unnecessary expense.

A carton having a rectangular base may be formed from a blank consisting of a wide panel, flanked on both sides by narrow panels which, in turn, are adjoined by two half panels for forming the other wide panel when connected with a longitudinal seam. On each side of the wall panels flap portions are provided for the bilateral closing of the bottom and top wall by means of a transverse waLl so that a folded construction is obtained. On either side of the narrow panels triangular fold lines are provided by means of which triangular ears are formed. In some carton constructions the triangular ear is provided with a pouring aperture, in others the ear can be torn or slit open by scissors. In cartons having a square base the side walls are of identical size.

The advantage of placing the pouring aperture in the triangular ear resides particularly in the fact that the carton may be practically entirely filled since the triangular ear has to be lifted for opening and therefore is situated above the level of the liquid contents.

An arrangement of the above-outlined type is disclosed in German Auslegeschrift (published examined application) 1,486,682. On the inside of the foldable triangular ear there is situated a tear-open pouring aperture which is covered by an additional strip. The latter projects beyond the triangular ear and therefore may be easily grasped. It is a disadvantage of this arrangement that additional manufacturing steps are needed for the positioning and gluing of the strip which leads to added expense in making the carton.

A similar solution is proposed in German Offenlegungsschrift No. (non-examined published application) 2,407,175, according to which a covering strip also seals a second, smaller aperture in the top wall to ensure an unimpeded air intake during use.

German Offenlegungsschrift No. 2,939,093 discloses the provision of a cutting line in one wall of the overlapping parts of the narrow side wall and the triangular ear and to connect the walls with a closely adjoining, very narrow welded seam in a liquidtight manner. The seam, however, should be of the type which can be torn open easily to expose the opening. Such a particular seal has to be provided in a very accurate manner to ensure a liquidtight closure.

SUMMARY OF THE INVENTION

It is an object of the invention to provide a carton for liquids which is very simple to manufacture, whose contents are packaged free from contamination, and in which the pouring aperture may be opened in a simple manner, while preventing an unintentional opening thereof.

These objects and others to become apparent as the specification progresses, are accomplished by this invention, according to which, briefly stated, the carton for storing flowable material has a side face formed of a side panel and an adjoining top face formed of top flaps and a triangular ear formed from one of the top flaps and being situated in a zone where the side face and the top face adjoin. A weakening line which is provided in the triangular ear encloses an area portion of the triangular ear. The latter is folded flat against the side panel and the area portion enclosed by the weakening line is firmly bonded to the side face of the carton. The triangular ear is free of a firm bond with the side face externally of the area portion enclosed by the weakening line, whereby upon lifting the triangular ear away from the side face, the area portion tears out of the triangular ear along the weakening line and thus remains bonded to the side face of the carton for obtaining a pouring aperture in the triangular ear, delimited by the weakening line.

DESCRIPTION OF THE PREFERRED EMBODIMENT

Figure 1:
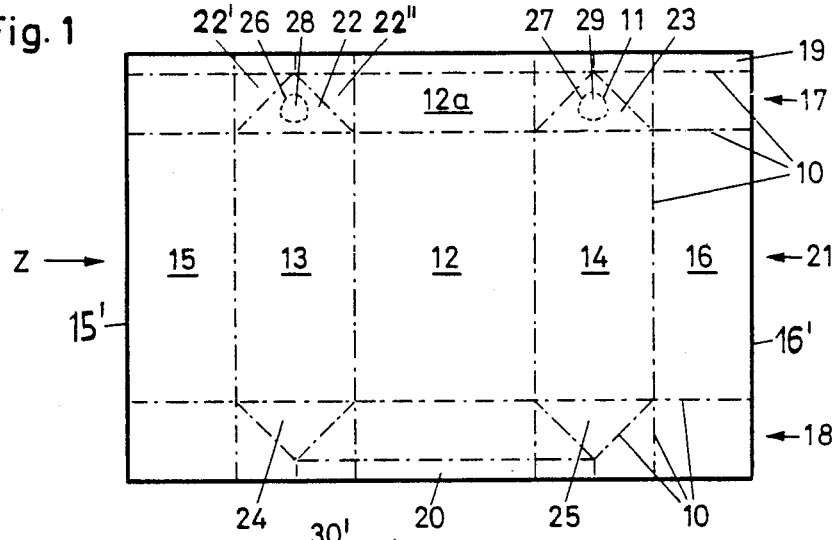
FIG. 1 is a top plan view of a blank for a carton according to a preferred embodiment of the invention.

Turning to FIG. 1, the blank Z is a cardboard bilaterally provided with a film of synthetic material. The blanks may be supplied as individual sheets or may be cut from a supply roll in which case weakening lines and fold lines may be provided prior to winding the continuous blank into a supply roll or may be provided upstream or downstream of a cutting station during the carton shaping process. Such preparatory steps are known and have no bearing on the invention.

The blank Z has a network of fold lines 10 shown in dash-dot lines and weakening lines 11 for tearing or separating, shown as short dashes.

The fold lines 10 define a central wide panel 12 having bilaterally adjoining narrow panels 13 and 14. To the sides of panels 13 and 14, remote from the panel 12, half panels 15 and 16 are attached which, when the carton sleeve is formed, are connected to one another at their respective free edges 15', 16' by a longitudinal seam and together form a second wide panel of the carton. On opposite sides of the panel field 21 formed of the panels 12–16 there are provided respective flap fields 17 and 18 which, similarly to the panel field 21 are subdivided into wide and narrow surfaces.

Along the flap field 17 there is provided a sealing margin 19 which extends along the entire blank Z and serves for forming the transverse seam at the top of the carton. On the opposite flap field 18 too, there is defined a sealing margin 20 which, however, extends only along the wide panel 12 and projects only half the distance into the narrow panels 13 and 14. At the bottom face (support face) of the carton there is thus effected only a rigid bonding of the various parts of the flap field 18.

Between the upper and lower fold lines 10 defining the panel field 21 on the one hand and the sealing margin 19, 20, on the other hand, in the flap fields 17 and 18 at both ends of the narrow panels 13 and 14, there are defined triangular surfaces 22, 23, 24 and 25 each having one side common with a bounding edge of narrow panels 13, 14. During the making of the carton from the blank Z, by virtue of the triangular surfaces, triangular ears (pocket flaps) are formed which will be discussed later as the specification progresses. In the triangular surfaces 22, 23 situated in the flap field 17 and constituting inferior (lower) surfaces of the pocket flaps respective pouring apertures 28 and 29 are delimited by weakening lines 26, 27. Along the indicated weakening lines 26 and 27 the cardboard is intermittently perforated and at least on the inside of the carton there is provided an unbroken sheet, such as an aluminum foil. The perforation of the cardboard may be provided prior to applying thereto the bilateral films to ensure that the wall structure is gastight and fluidtight despite the presence of the weakening lines. The ratio of the area of the pouring aperture to the triangular surface in which it is provided is between 1:2 and 1:4.

Figure 2:
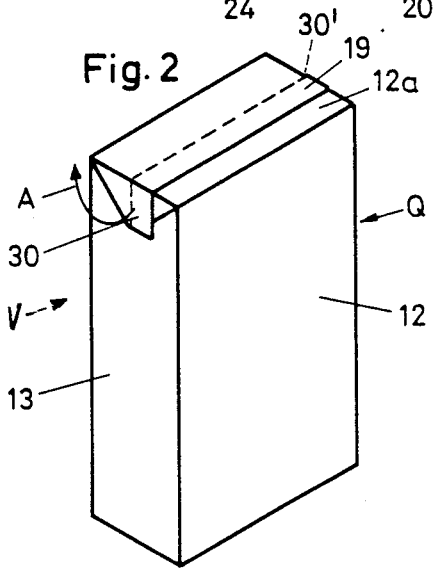
FIG. 2 is a perspective view of a carton made from the blank of FIG. 1, shown in a sealed state.

Turning to FIG. 2, there is shown a carton Q which is conventionally filled from the top and then closed. Thus, also conventionally, first the sealing margin 19 is closed, whereby simultaneously there is formed a triangular ear 30 from triangular faces 22, 22', 22'' and a triangular ear 30' from triangular faces 23, 23', 23''. Finally, the upstanding top part is folded onto the face 12*a* of the flap field 17. The triangular ears 30, 30' are glued to the respective narrow panels 13 and 14 which form the narrow side walls of the carton Q.

According to the invention, the triangular ear portion occupying the area of what will eventually become the pouring openings 28 and 29 is formly bonded to the adjoining exterior surfaces of the respective panels 13 and 14. The other surface portions of the triangular ears 30, 30' are releasably sealed to the panels 13 and 14. It is noted that in FIG. 2 the longitidunal seam connecting the two half panels 15 and 16 is not shown: it is an expedient well known in the art.

Figure 3:
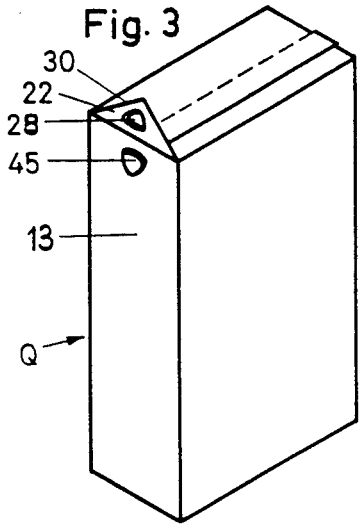
FIG. 3 is a view similar to FIG. 2, illustrating a pouring aperture in an opened, raised state.
Figure 4:
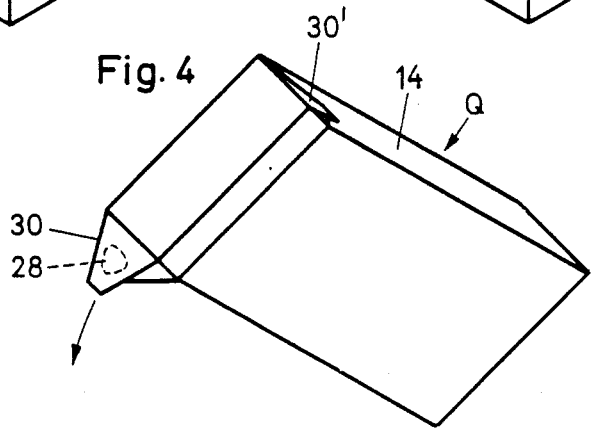
FIG. 4 illustrates the structure of FIG. 3 in a pouring position.

Upon tearing, for example, the left-side triangular ear 30 as indicated with the arrow A in FIG. 2, the releasably sealed ear portion is freed from the panel 13, while the firmly sealed small area situated within the pouring aperture 28 is, by virtue of the weakening line 26, torn out and remains glued to the narrow panel 13 as indicated at 45 in FIG. 3. This results, as shown in FIGS. 3 and 4, in an opened pouring aperture 28 in the underside of the triangular ear 30.

Figure 6:
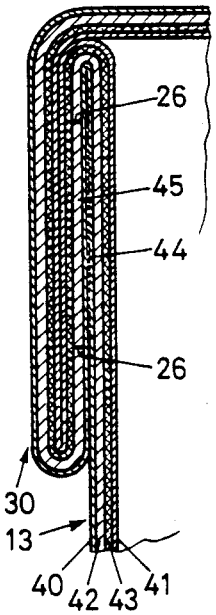
FIG. 6 is a sectional view taken along line VI—VI of FIG. 5.
Figure 5:
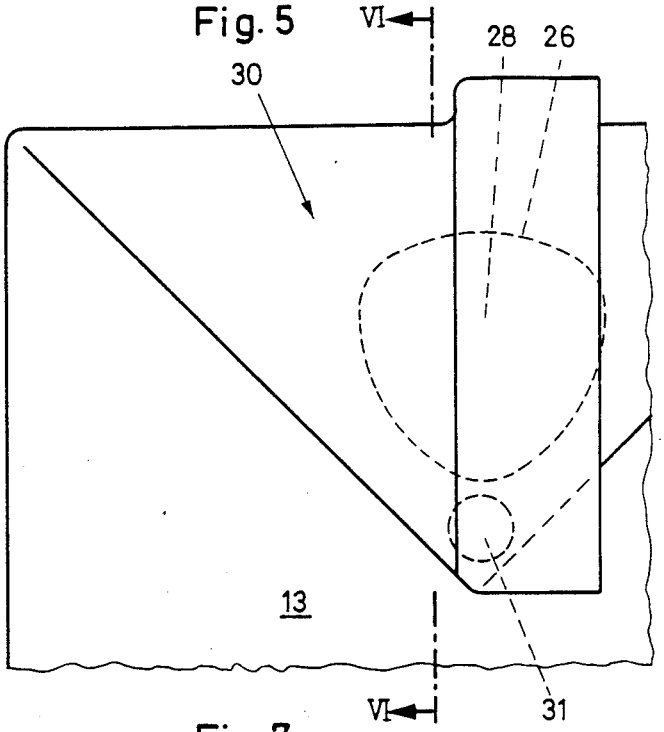
FIG. 5 is an enlarged fragmentary side elevational view of the structure shown in FIG. 2, as viewed in the direction of the arrow V.

The upper part of the carton according to the invention is shown on an enlarged scale in the closed (sealed) state in FIGS. 5 and 6. In FIG. 5, the pouring aperture 28 has the shape of a lamniscate curve; in the alternative, it may be of generally triangular configuration with rounded sides and corners. The area 31 designates an additional releasable bond between the triangular ear 30 and the panel 13.

Turning in particular to FIG. 6, there is shown in section the cardboard 42 coated bilaterally by films 40, 41. At the inside of the package, between the film 41 and the cardboard 42 there is additionally provided an aluminum foil 43. The films 40 and 41 are made of a heat-sealable material, such as polyethylene.

According to an advantageous variant the film 41 is made of polyethylene and the film 40 of a different material like ethylene-vinylacetate (EVA).

Thus, as noted earlier, solely the area 44 constitutes a firm bond between the ear 30 and the panel 13. In this manner, the closure part 45 delimited by the weakening line 26 is connected with high strength to the panel 13, while externally of the weakening line 26 only a weak, spotwise bond is present. As seen in FIG. 6, the external, heat-sealable film 40 of the carton is folded onto itself to assume a face-to-face contacting relationship in the zone where the triangular ear 30 lies flat against the side panel 13. Thus, in the area 44 the film is firmly bonded to itself.

Figure 7:
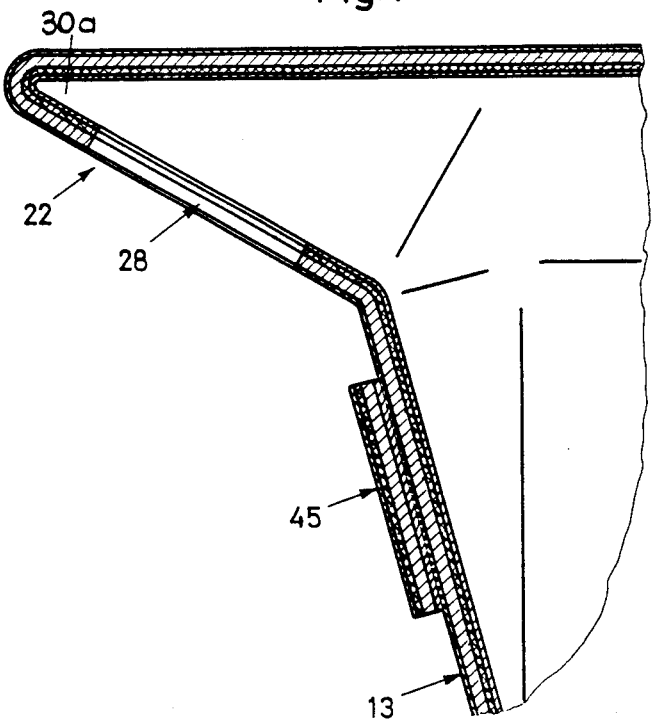
FIG. 7 is a sectional view of the components of FIG. 6, showing the structure in the pouring position as in FIG. 4.

If the triangular ear 30 is freed from the panel 13 from its position shown in FIG. 6 to a position shown in FIG. 3, or the enlarged sectional FIG. 7, the closure part 45 is torn out of the triangular surface (interior pocket surface) 22 and remains glued tothe panel 13. In this manner the pouring aperture 28 of the carton Q is provided. The contents of the carton Q can now be poured out as illustrated in FIG. 4. As it may be observed particularly in FIG. 5, taken in conjunction with FIG. 7, any diameteral dimension of the area of aperture 28 is several times greater than the wall thickness of the carton and thus the aperture 28 can readily serve as a pouring aperture.

It has been found that practically no liquid remains in the inner space defined by the triangular ear 30, but the liquid flows out by virtue of the favorably shaped (downwardly widening) aperture 28 and is thus not likely to enter into the corner region 30a of the triangular ear 30. It will be understood that the right-side triangular ear 30' having a pouring aperture 29 is arranged identically to the ear 30 so that the same operation may be performed thereon as was described in connection with the triangular ear 30.

The present disclosure relates to subject matter contained in Swiss Patent Application No. 5416/85 filed Dec. 19, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a carton for storing flowable material therein; said carton being formed of a cardboard sheet sandwiched between a sealable layer and a liquid-impervious layer; said carton including a side face having an exterior surface and being formed of a side panel and an adjoining top face formed of top flaps and a triangular ear constituting a pocket flap; said triangular ear having an inferior surface and being formed from one of the top flaps and being situated in a zone where said side face and said top face adjoin, the improvement comprising a weakening line provided solely in said cardboard in.the inferior surface of said triangular ear and enclosing an area portion of said triangular ear; at least one of the layers between which the cardboard sheet is sandwiched uninterruptedly covering said weakening line; said triangualr ear being of double-thickness of material and being folded flat against said side panel whereby the sealable layer on said side panel is in a face-to-face contacting relationship with the sealable layer on the flat-folded triangular ear; the sealable layer within said area portion of said triangular ear being, in a sealed unbroken state of the carton, firmly bonded to the sealable layer on the exterior surface of said side face; in said sealed, unbroken state said at least one layer hermetically separating an interior of the carton from the environment in the zone of contact between the triangular ear and the side panel; the sealable layer on said triangular ear being free from a firm bond with the sealable layer on said side face externally of said area portion, whereby upon lifting said triangular ear away from said side face, said area portion tears out of said triangular ear along said weakening line while remaining bonded to said exterior surface of said side face for obtaining a pouring aperture in said triangular ear, delimited by said weakening line.

2. A carton as defined in claim 1, further wherein said triangular ear is releasably bonded to said side face at a location externally of said area portion.

3. A carton as defined in claim 2, wherein said triangular ear is releasably bonded to said side face by an adhesive.

4. A carton as defined in claim 3, wherein said adhesive is a hot-melt adhesive.

5. A carton as defined in claim 3, wherein said adhesive is applied to a spot-like area in a zone of an outer corner of said triangular ear.

6. A carton as defined in claim 1, further; said weakening line being formed of a series of perforations provided in said cardboard.

7. A carton as defined in claim 1, wherein the pocket flap has an interior defined by internal surfaces of the triangular ear; said internal surfaces being free from any bond or adhesive zones up to depths of folds of the triangular ear.

8. A carton as defined in claim 1, wherein said at least one layer is said sealable layer.

9. A carton as defined in claim 1, wherein said at least one layer is said liquid-impervious layer.

10. A carton as defined in claim 1, wherein said sealable layer is a heat-sealable layer.

11. A carton as defined in claim 1, wherein said liquid-impervious layer is an aluminum foil.

12. A carton as defined in claim 11, further comprising an additional liquid-impervious layer applied to said aluminum foil; said aluminum foil being sandwiched between said cardboard sheet and said additional liquid-impervious layer.

* * * * *